US009249749B2

(12) United States Patent
Brennan

(10) Patent No.: US 9,249,749 B2
(45) Date of Patent: Feb. 2, 2016

(54) SYSTEM AND METHOD FOR CONTROLLING A FIRING PATTERN OF AN ENGINE TO REDUCE VIBRATION WHEN CYLINDERS OF THE ENGINE ARE DEACTIVATED

(71) Applicant: GM Global Technology Operations LLC, Detroit, MI (US)

(72) Inventor: Daniel G. Brennan, Brighton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 3 days.

(21) Appl. No.: 13/799,116

(22) Filed: Mar. 13, 2013

(65) Prior Publication Data

US 2014/0102411 A1 Apr. 17, 2014

Related U.S. Application Data

(60) Provisional application No. 61/713,867, filed on Oct. 15, 2012.

(51) Int. Cl.

| | |
|---|---|
| ***F02D 41/00*** | (2006.01) |
| ***F02D 17/00*** | (2006.01) |
| ***F02D 41/02*** | (2006.01) |

(52) U.S. Cl.

CPC ..... *F02D 41/0087* (2013.01); *F02D 17/00* (2013.01); *F02D 41/021* (2013.01); *F02D 2200/50* (2013.01)

(58) Field of Classification Search

USPC ..... 123/481, 350, 129 F, 325, 332, 406.21, 123/406.29; 701/101, 111, 112

See application file for complete search history.

(56) References Cited

U.S. PATENT DOCUMENTS

| | | | | |
|---|---|---|---|---|
| 4,172,434 | A | 10/1979 | Coles | |
| 4,377,997 | A | 3/1983 | Staerzl | |
| 4,434,767 | A | 3/1984 | Kohama et al. | |
| 4,489,695 | A | 12/1984 | Kohama et al. | |
| 4,509,488 | A * | 4/1985 | Forster | F02P 9/002 123/198 F |
| 4,535,744 | A * | 8/1985 | Matsumura | F02D 17/02 123/325 |
| 5,042,444 | A * | 8/1991 | Hayes | F02D 17/02 123/198 F |
| 5,094,213 | A | 3/1992 | Dudek et al. | |

(Continued)

FOREIGN PATENT DOCUMENTS

| | | | |
|---|---|---|---|
| CN | 1888407 | A | 1/2007 |
| CN | 101353992 | A | 1/2009 |
| CN | 102454493 | A | 5/2012 |

OTHER PUBLICATIONS

U.S. Appl. No. 13/798,351, filed Mar. 13, 2013, Rayl.

(Continued)

*Primary Examiner* — Stephen K Cronin
*Assistant Examiner* — Kevin R Steckbauer

(57) ABSTRACT

A system according to the principles of the present disclosure includes a vibration characteristics module and a firing pattern module. The vibration characteristics module, for a first plurality of firing patterns of an engine when a cylinder of the engine is deactivated, stores vibration characteristics associated with at least one of an amplitude, a frequency, and a phase of vibration at a driver interface component resulting from the first plurality of firing patterns. The firing pattern module selects a firing pattern from a second plurality of firing patterns and executes the firing pattern when the vibration characteristics associated with the selected firing pattern satisfies predetermined criteria.

20 Claims, 3 Drawing Sheets

(56) References Cited

U.S. PATENT DOCUMENTS 5,226,513 A 7/1993 Shibayama
5,278,760 A 1/1994 Ribbens et al.
5,357,932 A 10/1994 Clinton et al.
5,374,224 A 12/1994 Huffmaster et al.
5,377,631 A 1/1995 Schechter
5,423,208 A 6/1995 Dudek et al.
5,465,617 A 11/1995 Dudek et al.
5,553,575 A 9/1996 Beck et al.
5,584,266 A 12/1996 Motose et al.
5,669,354 A 9/1997 Morris
5,692,471 A 12/1997 Zhang
5,720,257 A 2/1998 Motose et al.
5,884,605 A 3/1999 Nagaishi et al.
5,909,720 A 6/1999 Yamaoka et al.
5,975,052 A 11/1999 Moyer
6,158,411 A 12/2000 Morikawa
6,244,242 B1 6/2001 Grizzle et al.
6,247,449 B1 6/2001 Persson
6,355,986 B1 * 3/2002 Kato ..... F16F 15/03 123/179.3
6,360,724 B1 3/2002 Suhre et al.
6,385,521 B1 5/2002 Ito
6,546,912 B2 4/2003 Tuken
6,619,258 B2 9/2003 McKay et al.
6,760,656 B2 7/2004 Matthews et al.
6,978,204 B2 12/2005 Surnilla et al.
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,121 B2 6/2006 Michelini et al.
7,069,718 B2 7/2006 Surnilla et al.
7,086,386 B2 8/2006 Doering
7,100,720 B2 9/2006 Ishikawa
7,111,612 B2 9/2006 Michelini et al.
7,140,355 B2 11/2006 Michelini et al.
7,174,879 B1 2/2007 Chol et al.
7,278,391 B1 10/2007 Wong et al.
7,292,231 B2 11/2007 Kodama et al.
7,292,931 B2 11/2007 Davis et al.
7,319,929 B1 1/2008 Davis et al.
7,363,111 B2 4/2008 Vian et al.
7,464,676 B2 12/2008 Wiggins et al.
7,497,074 B2 3/2009 Surnilla et al.
7,499,791 B2 3/2009 You et al.
7,503,312 B2 3/2009 Surnilla et al.
7,509,201 B2 3/2009 Bolander et al.
7,577,511 B1 8/2009 Tripathi et al.
7,685,976 B2 3/2010 Marriott
7,785,230 B2 8/2010 Gibson et al.
7,836,866 B2 11/2010 Luken et al.
7,849,835 B2 * 12/2010 Tripathi ..... F02D 41/0087 123/350
7,886,715 B2 2/2011 Tripathi et al.
7,930,087 B2 4/2011 Gibson et al.
7,954,474 B2 6/2011 Tripathi et al.
8,099,224 B2 1/2012 Tripathi et al.
8,108,132 B2 1/2012 Reinke
8,131,445 B2 3/2012 Tripathi et al.
8,131,447 B2 3/2012 Tripathi et al.
8,135,410 B2 3/2012 Forte
8,145,410 B2 3/2012 Berger et al.
8,146,565 B2 4/2012 Leone et al.
8,272,367 B2 9/2012 Shikama et al.
8,473,179 B2 6/2013 Whitney et al.
8,616,181 B2 12/2013 Sahandiesfanjani et al.
8,646,430 B2 2/2014 Kinoshita
8,646,435 B2 * 2/2014 Dibble ..... F02D 41/0087 123/198 DB
8,701,628 B2 4/2014 Tripathi et al.
8,833,058 B2 9/2014 Ervin et al.
8,833,345 B2 9/2014 Pochner et al.
8,869,773 B2 * 10/2014 Tripathi ..... F02D 28/00 123/350
2002/0162540 A1 11/2002 Matthews et al.
2003/0116130 A1 6/2003 Kisaka et al.
2003/0123467 A1 7/2003 Du et al.
2003/0131820 A1 7/2003 Mckay et al.
2003/0172900 A1 9/2003 Boyer et al.
2004/0206072 A1 10/2004 Surnilla et al.
2005/0016492 A1 1/2005 Matthews
2005/0131618 A1 6/2005 Megli et al.
2005/0197761 A1 9/2005 Bidner et al.
2005/0199220 A1 9/2005 Ogiso
2005/0204726 A1 9/2005 Lewis
2005/0204727 A1 9/2005 Lewis et al.
2005/0205028 A1 9/2005 Lewis et al.
2005/0205045 A1 9/2005 Michelini et al.
2005/0205060 A1 9/2005 Michelini et al.
2005/0205063 A1 9/2005 Kolmanovsky et al.
2005/0205069 A1 9/2005 Lewis et al.
2005/0205074 A1 9/2005 Gibson et al.
2005/0235743 A1 10/2005 Stempnik et al.
2006/0107919 A1 5/2006 Nishi et al.
2007/0042861 A1 2/2007 Takaoka et al.
2007/0107692 A1 5/2007 Kuo et al.
2007/0131196 A1 6/2007 Gibson et al.
2007/0235005 A1 10/2007 Lewis
2008/0066699 A1 3/2008 Michelini et al.
2008/0154468 A1 6/2008 Berger et al.
2008/0288146 A1 11/2008 Beechie et al.
2009/0007877 A1 1/2009 Raiford
2009/0030594 A1 1/2009 You et al.
2009/0042458 A1 2/2009 Kinoshita
2009/0118975 A1 5/2009 Murakami et al.
2009/0177371 A1 * 7/2009 Reinke ..... F02D 17/04 701/111
2009/0248277 A1 10/2009 Shinagawa et al.
2009/0248278 A1 10/2009 Nakasaka
2010/0006065 A1 1/2010 Tripathi et al.
2010/0010724 A1 1/2010 Tripathi et al.
2010/0012072 A1 1/2010 Leone et al.
2010/0050993 A1 3/2010 Zhao et al.
2010/0059004 A1 3/2010 Gill
2010/0100299 A1 4/2010 Tripathi et al.
2010/0192925 A1 8/2010 Sadakane
2010/0211299 A1 8/2010 Lewis et al.
2010/0318275 A1 * 12/2010 Borchsenius ..... F02D 41/3809 701/102
2011/0030657 A1 2/2011 Tripathi et al.
2011/0048372 A1 3/2011 Dibble et al.
2011/0107986 A1 5/2011 Winstead
2011/0144883 A1 6/2011 Rollinger et al.
2011/0208405 A1 8/2011 Tripathi et al.
2011/0213540 A1 9/2011 Tripathi et al.
2011/0213541 A1 9/2011 Tripathi et al.
2011/0251773 A1 10/2011 Sahandiesfanjani et al.
2012/0055444 A1 3/2012 Tobergte et al.
2012/0109495 A1 * 5/2012 Tripathi ..... F02D 41/30 701/102
2012/0116647 A1 5/2012 Pochner et al.
2012/0143471 A1 * 6/2012 Tripathi ..... F02D 28/00 701/102
2012/0221217 A1 8/2012 Sujan et al.
2012/0285161 A1 11/2012 Kerns et al.
2013/0092127 A1 4/2013 Pirjaberi et al.
2013/0092128 A1 * 4/2013 Pirjaberi ..... F02D 41/0087 123/406.23
2013/0289853 A1 10/2013 Serrano
2014/0041625 A1 2/2014 Pirjaberi et al.
2014/0053802 A1 2/2014 Rayl
2014/0053804 A1 2/2014 Rayl et al.
2014/0053805 A1 * 2/2014 Brennan ..... F02D 41/0087 123/350
2014/0069178 A1 * 3/2014 Beikmann ..... G01L 23/22 73/114.07
2014/0069378 A1 3/2014 Burleigh et al.
2014/0069379 A1 3/2014 Beikmann
2014/0069381 A1 3/2014 Beikmann
2014/0090623 A1 4/2014 Beikmann

(56) References Cited

U.S. PATENT DOCUMENTS

| | | | |
|---|---|---|---|
| 2014/0090624 | A1 | 4/2014 | Verner |
| 2014/0102411 | A1 | 4/2014 | Brennan |

OTHER PUBLICATIONS

U.S. Appl. No. 13/798,384, filed Mar. 13, 2013, Burtch.
U.S. Appl. No. 13/798,400, filed Mar. 13, 2013, Phillips.
U.S. Appl. No. 13/798,435, filed Mar. 13, 2013, Matthews.
U.S. Appl. No. 13/798,451, filed Mar. 13, 2013, Rayl.
U.S. Appl. No. 13/798,471, filed Mar. 13, 2013, Matthews et al.
U.S. Appl. No. 13/798,518, filed Mar. 13, 2013, Beikmann.
U.S. Appl. No. 13/798,536, filed Mar. 13, 2013, Matthews et al.
U.S. Appl. No. 13/798,540, filed Mar. 13, 2013, Brennan et al.
U.S. Appl. No. 13/798,574, filed Mar. 13, 2013, Verner.
U.S. Appl. No. 13/798,586, filed Mar. 13, 2013, Rayl et al.
U.S. Appl. No. 13/798,590, filed Mar. 13, 2013, Brennan et al.
U.S. Appl. No. 13/798,624, filed Mar. 13, 2013, Brennan et al.
U.S. Appl. No. 13/798,701, filed Mar. 13, 2013, Burleigh et al.
U.S. Appl. No. 13/798,737, filed Mar. 13, 2013, Beikmann.
U.S. Appl. No. 13/798,775, filed Mar. 13, 2013, Phillips.
U.S. Appl. No. 13/799,129, filed Mar. 13, 2013, Beikmann.
U.S. Appl. No. 13/799,181, filed Mar. 13, 2013, Beikmann.
U.S. Appl. No. 14/211,389 dated Mar. 14, 2014, Liu et al.
U.S. Appl. No. 14/300,469, dated Jun. 10, 2014, Li et al.
U.S. Appl. No. 14/310,063, dated Jun. 20, 2014, Wagh et al.
U.S. Appl. No. 14/449,726, dated Aug. 1, 2014, Hayman et al.
U.S. Appl. No. 14/548,501, dated Nov. 20, 2014, Beikmann et al.
U.S. Appl. No. 61/952,737, dated Mar. 13, 2014, Shost et al.
U.S. Appl. No. 14/734,619, filed Jun. 9, 2015, Matthews.
International Search Report and Written Opinion dated Jun. 17, 2015 corresponding to International Application No. PCT/US2015/019496, 14 pages.

* cited by examiner

SYSTEM AND METHOD FOR CONTROLLING A FIRING PATTERN OF AN ENGINE TO REDUCE VIBRATION WHEN CYLINDERS OF THE ENGINE ARE DEACTIVATED

CROSS-REFERENCE TO RELATED APPLICATIONS

This application claims the benefit of U.S. Provisional Application No. 61/713,867, filed on Oct. 15, 2012. The disclosure of the above application is incorporated herein by reference in its entirety.

This application is related to U.S. patent application Ser. No. 13/798,451 filed on Mar. 13, 2013, Ser. No. 13/798,351 filed on Mar. 13, 2013, Ser. No. 13/798,586 filed on Mar. 13, 2013, Ser. No. 13/798,590 filed on Mar. 13, 2013, Ser. No. 13/798,536 filed on Mar. 13, 2013, Ser. No. 13/798,435 filed on Mar. 13, 2013, Ser. No. 13/798,471 filed on Mar. 13, 2013, Ser. No. 13/798,737 filed on Mar. 13, 2013, Ser. No. 13/798,701 filed on Mar. 13, 2013, Ser. No. 13/798,518 filed on Mar. 13, 2013, Ser. No. 13/799,129 filed on Mar. 13, 2013, Ser. No. 13/798,540 filed on Mar. 13, 2013, Ser. No. 13/798,574 filed on Mar. 13, 2013, Ser. No. 13/799,181 filed on Mar. 13, 2013, Ser. No. 13/798,624 filed on Mar. 13, 2013, Ser. No. 13/798,384 filed on Mar. 13, 2013, Ser. No. 13/798,775 filed on Mar. 13, 2013, and Ser. No. 13/798,400 filed on Mar. 13, 2013. The entire disclosures of the above applications are incorporated herein by reference.

FIELD

The present disclosure relates to systems and methods for controlling a firing pattern of an engine to reduce vibration when cylinders of the engine are deactivated.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

Under some circumstances, one or more cylinders of an engine may be deactivated to decrease fuel consumption. For example, one or more cylinders may be deactivated when the engine can produce a requested amount of torque while the cylinder(s) are deactivated. Deactivation of a cylinder may include disabling opening of intake and exhaust valves of the cylinder and disabling spark and fueling of the cylinder.

SUMMARY

A system according to the principles of the present disclosure includes a vibration characteristics module and a firing pattern module. The vibration characteristics module, for a first plurality of firing patterns of an engine when a cylinder of the engine is deactivated, stores vibration characteristics associated with at least one of an amplitude, a frequency, and a phase of vibration at a driver interface component resulting from the first plurality of firing patterns. The firing pattern module selects a firing pattern from a second plurality of firing patterns and executes the firing pattern when the vibration characteristics associated with the selected firing pattern satisfies predetermined criteria.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
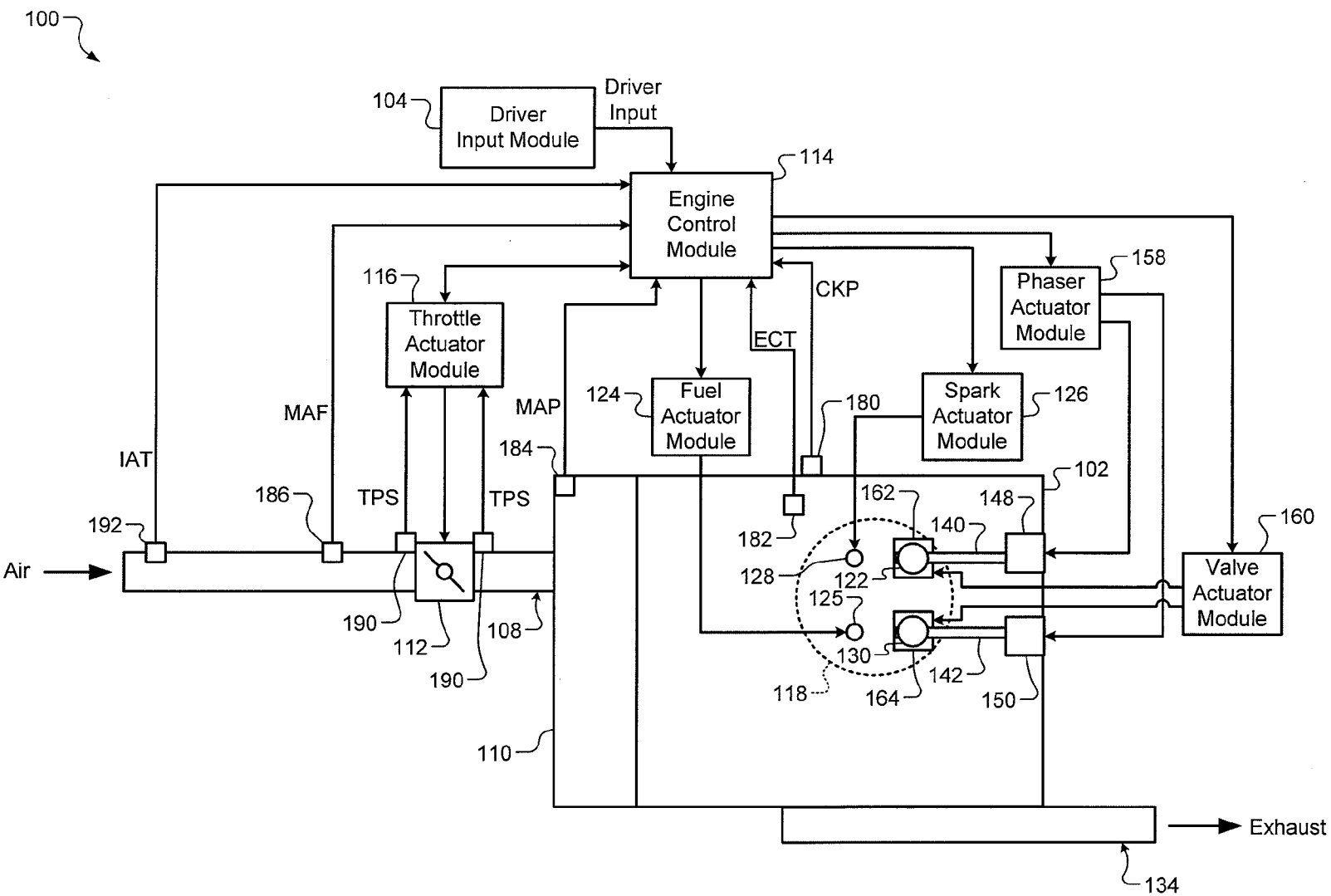
FIG. 1 is a functional block diagram of an example engine system according to the principles of the present disclosure.

When a cylinder deactivation system deactivates cylinders of an engine, a firing pattern of the engine may be adjusted to achieve a desired number of deactivated cylinders and/or to change which cylinders are deactivated. The firing pattern may be adjusted without regard to the noise and vibration performance of a vehicle. Thus, a driver may perceive an increase in the noise and vibration during cylinder deactivation.

Engine vibration is transmitted to driver interface components, such as a seat, a steering wheel, and pedals, through a vehicle structure between powertrain mounts and the driver interface components. Vibration at the driver interface components may be quantified using, for example, a displacement distribution in a frequency spectrum. The displacement distribution may be assigned a color, such as white or pink, based on the variation of the displacement distribution. A driver may perceive an increase in the vehicle noise and vibration as the variation of a displacement distribution increases.

White noise and vibration may indicate equal-amplitude displacement in any band of a frequency spectrum. For example, white noise and vibration has the same amount of displacement in the frequency range between 40 Hertz (Hz) and 60 Hz as in the frequency range between 400 Hz and 420 Hz. Pink noise and vibration may indicate equal-amplitude displacement in frequency bands that are proportionally wide. For example, pink noise and vibration may have the same amount of displacement in the frequency range between 40 Hz and 60 Hz as in the frequency range between 4000 Hz and 6000 Hz. White noise and vibration may be difficult to achieve. Pink noise and vibration may be achievable and may yield equal-amplitude displacement within frequency ranges to which a driver is most sensitive.

A firing pattern may be randomly adjusted during cylinder deactivation to flatten out a displacement distribution associated with vibration at the driver interface components. However, some firing patterns may excite natural resonances of the vehicle structure between the powertrain mounts and the driver interface components, causing spikes in the displacement distribution. Thus, randomly adjusting a firing pattern without regard to the vibration characteristics of the firing pattern may increase the amount of noise and vibration perceived by a driver.

A control system and method according to the present disclosure selects a firing pattern based on its vibration characteristics of the firing pattern to reduce noise and vibration during cylinder deactivation. The vibration characteristics of multiple firing patterns may be predetermined using, for example, modal analysis and/or physical testing. The vibration characteristics may include whether vibration resulting from the firing pattern satisfies predetermined criteria related to amplitude, frequency, and/or phase. In one example, the vibration satisfies the predetermined criteria when the amplitude is less than a predetermined displacement. If the vibration satisfies the predetermined criteria, the firing pattern may be designated as a desired firing pattern. Otherwise, the firing pattern may be designated as an undesired firing pattern.

During engine operation, a firing pattern may be randomly selected from a set of possible firing patterns that include enough firing events to satisfy a driver torque request. Vibration characteristics of the selected firing pattern may then be retrieved. If the vibration characteristics satisfy the predetermined criteria, such as being designated a desired firing pattern, the firing pattern may be executed. Otherwise, another firing pattern may be selected.

In various implementations, the selected firing pattern, which may be executed in the future, may be combined with cylinder events (e.g., firing events, non-firing events) from one or more previous firing patterns that have already been executed. Vibration characteristics of the combined firing pattern may then be retrieved. If the vibration characteristics satisfy the predetermined criteria, the selected firing pattern may be executed. Otherwise, another firing pattern may be selected.

In various implementations, the selected firing pattern may be executed when vibration from the selected firing pattern destructively interferes with vibration from the previous firing patterns. Destructive interference occurs when a phase difference between the vibrations from the two firing patterns is a value, such as $\pi$, $3\pi$, $5\pi$, etc., which causes the vibration from the selected firing pattern to dampen the vibration from the previous firing patterns. In contrast, constructive interference occurs when a phase difference between the vibrations associated with the two firing patterns is a value, such as a multiple of $2\pi$, which causes the vibration from the selected firing pattern to amplify the vibration from the previous firing patterns. The amplitude of vibration from the combined firing pattern may be used to determine whether vibration from the selected firing pattern destructively interferes with vibration from the previous firing patterns.

Referring now to FIG. 1, an engine system 100 includes an engine 102 that combusts an air/fuel mixture to produce drive torque for a vehicle. The amount of drive torque produced by the engine 102 is based on driver input from a driver input module 104. Air is drawn into the engine 102 through an intake system 108. The intake system 108 includes an intake manifold 110 and a throttle valve 112. The throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. For illustration purposes, a single representative cylinder 118 is shown. However, the engine 102 may include multiple cylinders. For example, the engine 102 may include 2, 3, 4, 5, 6, 8, 10, and/or 12 cylinders. The ECM 114 may deactivate one or more of the cylinders, which may improve fuel economy under certain engine operating conditions.

The engine 102 may operate using a four-stroke cycle. The four strokes include an intake stroke, a compression stroke, a combustion stroke, and an exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates a fuel injector 125 to control the amount of fuel provided to the cylinder to achieve a desired air/fuel ratio. The fuel injector 125 may inject fuel directly into the cylinder 118 or into a mixing chamber associated with the cylinder 118. The fuel actuator module 124 may halt fuel injection into cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 in the cylinder 118 based on a signal from the ECM 114. The spark ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. A firing event causes combustion in a cylinder when an air/fuel mixture is provided to the cylinder (e.g., when the cylinder is active). The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, the combustion of the air/fuel mixture drives the piston down, thereby driving the crankshaft. As the combustion of the air/fuel mixture drives the piston down, the piston moves from TDC to its bottom-most position, referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The time at which the intake valve 122 is opened may be varied with respect to piston TDC by an intake cam phaser 148. The time at which the exhaust valve 130 is opened may be varied with respect to piston TDC by an exhaust cam phaser 150. The ECM 114 may disable opening of the intake and exhaust valves 122, 130 of cylinders that are deactivated. A phaser actuator module 158 may control the intake cam phaser 148 and the exhaust cam phaser 150 based on signals from the ECM 114. When implemented, variable valve lift (not shown) may also be controlled by the phaser actuator module 158.

The ECM 114 may deactivate the cylinder 118 by instructing a valve actuator module 160 to deactivate opening of the intake valve 122 and/or the exhaust valve 130. The valve actuator module 160 controls an intake valve actuator 162 that opens and closes the intake valve 122. The valve actuator module 160 controls an exhaust valve actuator 164 that opens and closes the exhaust valve 130. In one example, the valve actuators 162, 164 include solenoids that deactivate opening of the valves 122, 130 by decoupling cam followers from the camshafts 140, 142. In another example, the valve actuators 162, 164 are electromagnetic or electrohydraulic actuators that control the lift, timing, and duration of the valves 122, 130 independent from the camshafts 140, 142. In this example, the camshafts 140, 142, the intake and exhaust cam phasers 148, 150, and the phaser actuator module 158 may be omitted.

The position of the crankshaft may be measured using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 114 may use signals from the sensors to make control decisions for the engine system 100.

The ECM 114 selects a firing pattern based on vibration characteristics of the firing pattern to reduce noise and vibration during cylinder deactivation. Initially, the ECM 114 may randomly select a firing pattern from a number of possible firing patterns that include enough firing events to satisfy a driver torque request. The ECM 114 may then retrieve stored information associated with the firing pattern, such as whether vibration resulting from the firing pattern satisfies predetermined criteria related to amplitude, frequency, and/or phase. If the vibration satisfies the predetermined criteria, the ECM 114 may execute the firing pattern. Otherwise, the ECM 114 may select another firing pattern.

Figure 2:
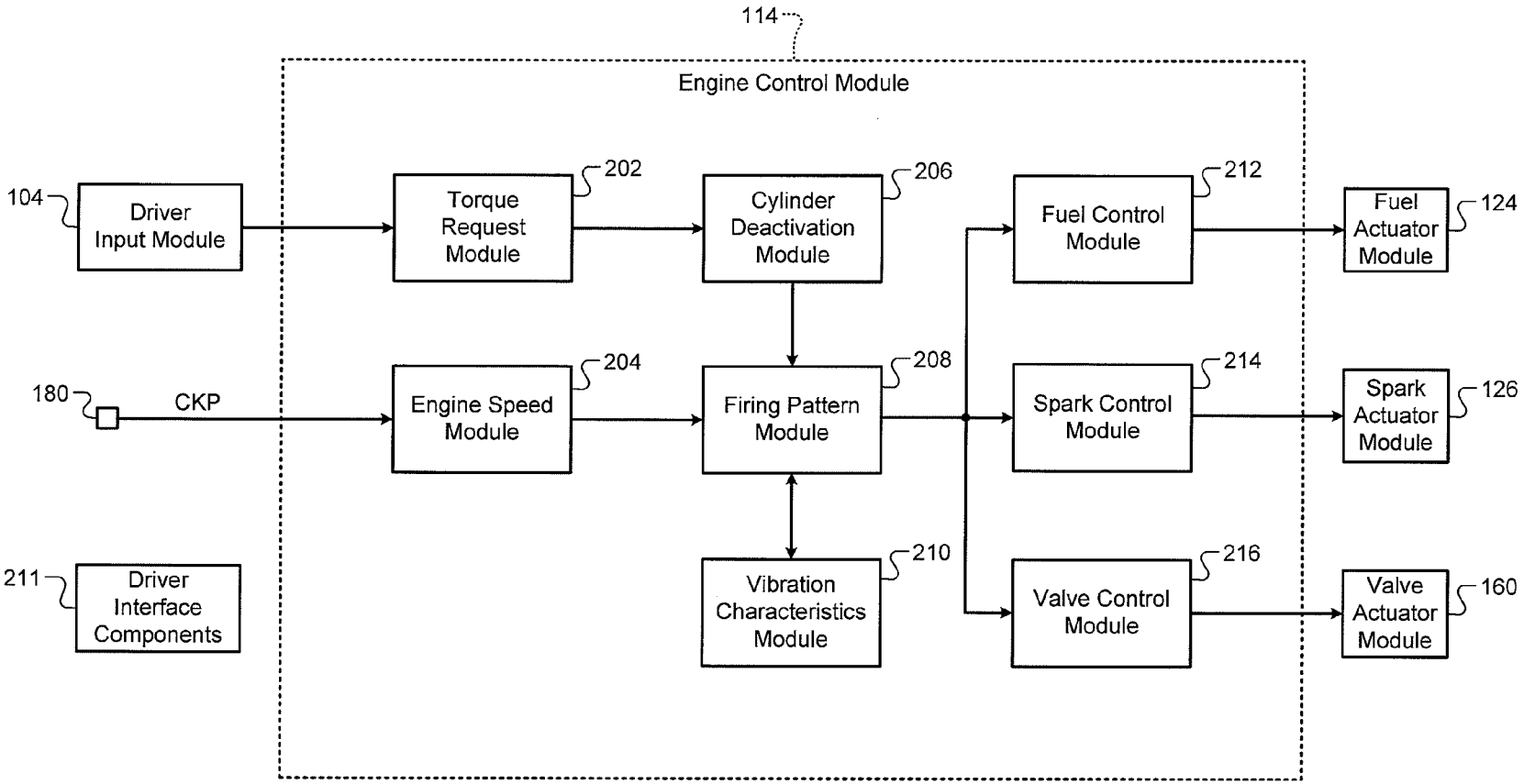
FIG. 2 is a functional block diagram of an example control system according to the principles of the present disclosure.

Referring now to FIG. 2, an example implementation of the ECM 114 includes a torque request module 202, an engine speed module 204, and a cylinder deactivation module 206. The torque request module 202 determines a driver torque request based on the driver input from the driver input module 104. The driver input may be based on a position of an accelerator pedal. The driver input may also be based on input from a cruise control system, which may be an adaptive cruise control system that varies vehicle speed to maintain a predetermined following distance. The torque request module 202 may store one or more mappings of accelerator pedal position to desired torque, and may determine the driver torque request based on a selected one of the mappings. The torque request module 202 outputs the driver torque request.

The engine speed module 204 determines engine speed. The engine speed module 204 may determine the engine speed based on input received from the CKP sensor 180. The engine speed module 204 may determine the engine speed based on an amount of crankshaft rotation between tooth detections and the corresponding period. The engine speed module 204 outputs the engine speed.

The cylinder deactivation module 206 deactivates cylinders in the engine 102 based on the driver torque request. The cylinder deactivation module 206 may deactivate one or more (e.g., all) cylinders in the engine 102 when the engine 102 can satisfy the driver torque request while the cylinder(s) are deactivated. The cylinder deactivation module 206 may reactivate the cylinders when the engine 102 cannot satisfy the driver torque request while the cylinder(s) are deactivated. The cylinder deactivation module 206 outputs the quantity of deactivated cylinders and/or the quantity of active cylinders.

A firing pattern module 208 determines a firing pattern of the cylinders in the engine 102. The firing pattern module 208 may assess and/or adjust the firing pattern after each engine cycle. Alternatively, the firing pattern module 208 may assess and/or adjust the firing pattern before each firing event in the engine 102. An engine cycle may correspond to 720 degrees of crankshaft rotation. A firing pattern may include one or more cylinder events. For example, a firing pattern may include 5, 6, 7, 8, 9, or 10 cylinder events. A cylinder event may refer to a firing event and/or a crank angle increment during which spark is generated in a cylinder when the cylinder is active. The firing pattern module 208 outputs the firing pattern.

The firing pattern module 208 may change the firing pattern from one engine cycle to the next engine cycle to change the quantity of active cylinders without changing the order in which cylinders are firing. For example, for an 8-cylinder engine having a firing order of 1-8-7-2-6-5-4-3, a firing pattern of 1-8-7-2-5-3 may be specified for one engine cycle, and a firing pattern of 1-7-2-5-3 may be specified for the next engine cycle. This decreases the quantity of active cylinders from 6 to 5.

The firing pattern module 208 may change the quantity of active cylinders from one engine cycle to the next engine cycle based on instructions received from the cylinder deactivation module 206. The cylinder deactivation module 206 may alternate the quantity of active cylinders between two integers to achieve an effective cylinder count that is equal to the average value of the two integers. For example, the cylinder deactivation module 206 may alternate the quantity of active cylinders between 5 and 6, resulting in an effective cylinder count of 5.5.

The firing pattern module 208 may change the firing pattern from one engine cycle to the next engine cycle to change which cylinders are firing, and thereby change which cylinders are active, without changing the quantity of active cylinders. For example, when three cylinders of the 8-cylinder engine described above are deactivated, a firing pattern of 1-7-2-5-3 may be specified for one engine cycle, and a firing pattern of 8-2-6-4-3 may be specified for the next engine cycle. This deactivates cylinders 1, 7, and 5 and reactivates cylinders 8, 6, and 4.

The firing pattern module 208 may select a firing pattern based on the quantity of active cylinders output by the cylinder deactivation module 206. The firing pattern module 208 may select a firing pattern from a number of firing patterns that achieve the required quantity of active cylinders. The firing pattern module 208 may select a firing pattern randomly, in a predetermined order, and/or in a manner that ensures the same firing pattern is not selected consecutively. The firing pattern module 208 outputs the selected firing pattern to a vibration characteristics module 210.

The vibration characteristics module 210 stores vibration characteristics associated with multiple firing patterns and outputs the vibration characteristics associated with the selected firing pattern. The characteristics may be associated with vibration at driver interface components 211, such as a seat, steering wheel, and/or pedals, resulting from a firing pattern. The vibration characteristics may be predetermined using, for example, a transfer function that characterizes vibration transmission through a vehicle structure between powertrain mounts and the driver interface components 211. The transfer function may be developed through modal analysis and/or physical testing.

The vibration characteristics module 210 may store vibration characteristics such as whether vibration resulting from a firing pattern satisfies predetermined criteria related to amplitude, frequency, and/or phase. In one example, the vibration satisfies the predetermined criteria when the amplitude of the vibration is less than a predetermined displacement. If the vibration satisfies the predetermined criteria, the vibration characteristics module 210 may designate the firing pattern as a desired firing pattern. Otherwise, the vibration characteristics module 210 may designate the firing pattern as an undesired firing pattern.

The predetermined displacement may be a function of the frequency of the vibration and/or the location of the vibration. In one example, for steering column vibration having a frequency of 20 Hz, the predetermined displacement may be about 0.038 millimeters (mm). In another example, for a steering column vibration having a frequency of 40 Hz, the predetermined displacement may be about 0.0182 mm. In another example, for vertical vibration at a seat track, the predetermined displacement may be between about 0.019 mm and 0.025 mm at 20 Hz and between about 0.0091 mm and 0.012 mm at 40 Hz.

The vibration characteristics module 210 may store vibration characteristics such as the amplitude, frequency, and/or phase of vibration resulting from a firing pattern. This requires more memory than simply storing whether such characteristics satisfy predetermined criteria, but enables differentiation between the desired firing patterns. The amplitude, frequency, and/or phase of vibration may vary depending on engine operating conditions such as the engine speed. Thus, the vibration characteristics module 210 may determine the amplitude, frequency, and/or phase using a lookup table that relates amplitude, frequency, and/or phase to engine speed.

Vibration resulting from a firing pattern may be affected by the firing patterns that precede the firing pattern. Thus, the vibration characteristics module 210 may combine the selected firing pattern, which may be executed in the future, with cylinder events from one or more previous firing patterns, which have already been executed. The vibration characteristics module 210 may then output the vibration characteristics associated with the combined firing pattern.

The number of cylinder events included in the combined firing pattern from the previous firing patterns may be sufficient to accurately capture the effect of previous cylinder events on the vibration resulting from the selected firing pattern. The number of previous cylinder events may be greater than the number of cylinder events in the selected firing pattern. In one example, six cylinder events are included from the previous firing patterns while only three cylinder events are included from the selected firing patterns. In this example, the combined firing pattern includes nine cylinder events.

The number of cylinder events included in the combined firing pattern from the previous firing patterns may be determined based on engine operating characteristics that affect vibration damping, such as engine speed. For example, as the engine speed increases, vibration resulting from a firing pattern dampens out over a fewer number of cylinder events. In contrast, as the engine speed decreases, vibration resulting from a firing pattern dampens out over a greater number of cylinder events. Thus, the number of cylinder events included in the combined firing pattern from the previous firing patterns may be inversely proportional to the engine speed.

The firing pattern module 208 determines whether to execute the selected firing pattern based on the vibration characteristics associated with the selected firing pattern or the combined firing pattern. In one example, the firing pattern module 208 executes the selected firing pattern when the selected firing pattern or the combined firing pattern is designated a desired firing sequence. In another example, the firing pattern module 208 executes the selected firing pattern when the amplitude of vibration resulting from the selected firing pattern or the combined firing pattern is less than the predetermined displacement within the predetermined frequency range.

In various implementations, the firing pattern module 208 may execute the selected firing pattern when vibration from the selected firing pattern destructively interferes with vibration from the previous cylinder events. In one example, the firing pattern module 208 may execute the selected firing pattern when vibration from the selected firing pattern decreases the amplitude of vibration from the previous cylinder events. The firing pattern module 208 may execute the selected firing pattern when vibration from the selected firing pattern decreases the amplitude of vibration from the previous cylinder events at a rate that is greater than a first rate. The first rate may be a decay rate of the vibration from the previous cylinder events before the vibration from the selected firing pattern interferes with the vibration from the previous cylinder events.

In various implementations, the firing pattern module 208 may select a firing pattern from a set of firing patterns that only includes firing patterns designated as desired firing patterns. In these implementations, the firing pattern module 208 may randomly select a firing pattern from the desired firing patterns while ensuring that the same firing pattern is not executed consecutively. In addition, the firing pattern module 208 may determine whether to execute the selected firing pattern based on the vibration characteristics associated with the combined firing pattern, as described above. Alternatively, the firing pattern module 208 may simply execute the selected firing pattern, in which case the vibration characteristics module 210 may be omitted.

If the firing pattern module 208 decides to execute the selected firing pattern, the firing pattern module 208 outputs the firing pattern to a fuel control module 212, a spark control module 214, and a valve control module 216. Otherwise, the firing pattern module 208 selects another firing pattern. The firing pattern module 208 may store the executed firing patterns and/or output the executed firing patterns to the vibration characteristics module 210 for use in selecting future firing patterns.

The fuel control module 212 instructs the fuel actuator module 124 to provide fuel to cylinders of the engine 102 according to the selected firing pattern. The spark control module 214 instructs the spark actuator module 126 to generate spark in cylinders of the engine 102 according to the selected firing pattern. The spark control module 214 may output a signal indicating which of the cylinders is next in the firing pattern. The valve control module 216 instructs the valve actuator module 160 to open intake and exhaust valves of the engine 102 according to the selected firing pattern.

Figure 3:
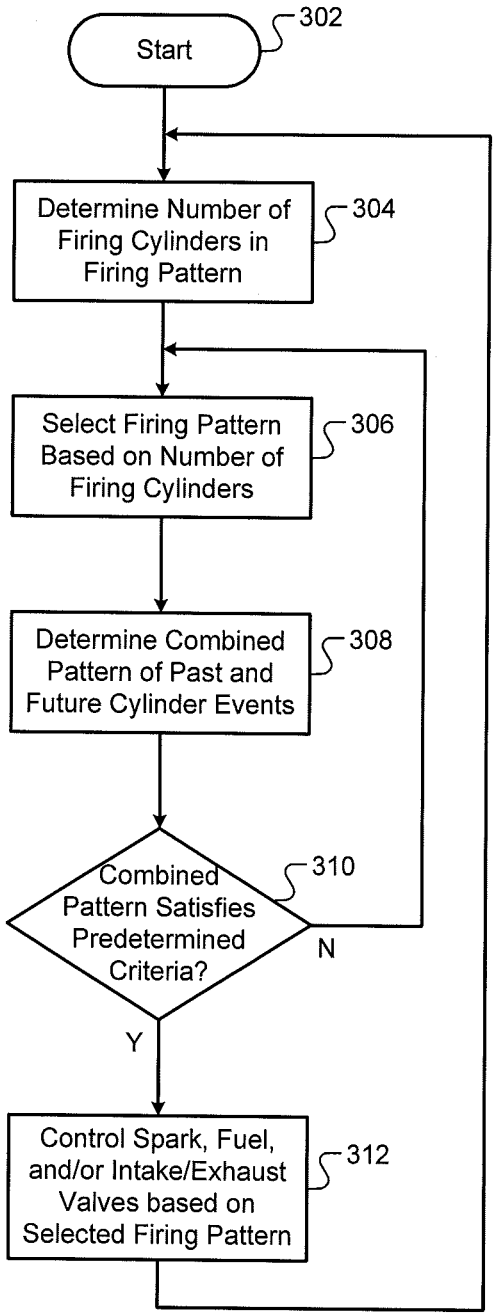
FIG. 3 is a flowchart illustrating an example control method according to the principles of the present disclosure.

Referring now to FIG. 3, a method for controlling a firing pattern of an engine to reduce vibration when cylinders of the engine are deactivated begins at 302. At 304, the method determines a number of firing cylinders in a firing pattern required to satisfy a driver torque request. The method may determine the driver torque request based on an accelerator pedal position and/or a cruise control setting.

At 306, the method selects a firing pattern based on the required number of firing cylinders. The method may select a firing pattern from a number of firing patterns that achieve the required quantity of active cylinders. The method may select a firing pattern randomly, in a predetermined order, and/or in a manner that ensures the same firing pattern is not selected consecutively.

At 308, the method combines the selected firing pattern, which may be executed in the future, with cylinder events from one or more previous firing patterns, which have already been executed. The number of cylinder events included in the combined firing pattern from the previous firing patterns may be determined based on engine operating characteristics that affect vibration damping, such as engine speed. For example, the number of cylinder events included in the combined firing pattern from the previous firing patterns may be inversely proportional to the engine speed.

At 310, the method determines whether vibration resulting from the combined firing pattern satisfies predetermined criteria related to amplitude, frequency, and/or phase. If the vibration satisfies the predetermined criteria, the method continues at 312. Otherwise, the method continues at 306. In one example, the vibration satisfies the predetermined criteria when the amplitude is less than a predetermined displacement.

The predetermined displacement may be a function of the frequency of the vibration and/or the location of the vibration. In one example, for steering column vibration having a frequency of 20 Hz, the predetermined displacement may be about 0.038 millimeters (mm). In another example, for a steering column vibration having a frequency of 40 Hz, the predetermined displacement may be about 0.0182 mm. In another example, for vertical vibration at a seat track, the predetermined displacement may be between about 0.019 mm and 0.025 mm at 20 Hz and between about 0.0091 mm and 0.012 mm at 40 Hz.

If vibration resulting from a firing pattern satisfies the predetermined criteria, the method may designate the firing pattern as a desired firing pattern. Otherwise, the method may designate the firing pattern as an undesired firing pattern. Then, the method may determine that the combined firing pattern satisfies the predetermined criteria when the combined firing pattern is designated as a desired firing pattern. Thus, instead of storing the amplitude, frequency, and/or phase resulting from a firing pattern, the method may simply store whether the firing pattern is designated as a desired firing pattern or an undesired firing pattern.

In various implementations, the method may determine whether vibration resulting from the selected firing pattern satisfies the predetermined criteria. This determination may be made instead of or in addition to determining whether vibration resulting from the combined firing pattern satisfies the predetermined criteria. In various implementations, the method may store only those firing patterns designated as desired firing patterns. In these implementations, the method may not determine whether vibration resulting from the selected firing pattern satisfies the predetermined criteria, as this determination has already been made. However, the method may still determine whether the combined firing pattern satisfies the predetermined criteria.

At 312, the method controls spark timing, fuel delivery, intake valve opening, and/or exhaust valve opening based on the selected firing pattern. The method may generate spark in cylinders of the engine according to the selected firing pattern. The method may deliver fuel to cylinders of the engine according to the selected firing pattern. The method may open intake and/or exhaust valves of the engine according to the selected firing pattern.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); a discrete circuit; an integrated circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be partially or fully implemented by one or more computer programs executed by one or more processors. The computer programs include processor-executable instructions that are stored on at least one non-transitory tangible computer readable medium. The computer programs may also include and/or rely on stored data. Non-limiting examples of the non-transitory tangible computer readable medium include nonvolatile memory, volatile memory, magnetic storage, and optical storage.

What is claimed is:

1. A system comprising:

a vibration characteristics module that stores vibration characteristics including at least one of an amplitude, a frequency, and a phase of vibration at a driver interface component, wherein each of the vibration characteristics is associated with one of a first plurality of firing patterns of an engine when a cylinder of the engine is deactivated; and a firing pattern module that selects a firing pattern from a second plurality of firing patterns and that executes the selected firing pattern when the vibration characteristics resulting from the selected firing pattern satisfy predetermined criteria.

2. The system of claim 1 wherein the firing pattern module randomly selects the selected firing pattern from the plurality of firing patterns.

3. The system of claim 1 wherein the second plurality of firing patterns includes those of the first plurality of firing patterns that include a sufficient number of firing events to satisfy a driver torque request.

4. The system of claim 1 where the vibration characteristics module designates as a desired firing pattern those of the plurality of firing patterns that satisfy the predetermined criteria.

5. The system of claim 1 wherein the firing pattern module executes the selected firing pattern when the selected firing pattern is designated as a desired firing pattern.

6. The system of claim 1 wherein the second plurality of firing patterns includes only those of the first plurality of firing patterns that satisfy the predetermined criteria.

7. The system of claim 1 wherein the vibration characteristics module combines the selected firing pattern with at least a portion of a previous firing pattern and determines the vibration characteristics of the combined firing pattern.

8. The system of claim 7 wherein the firing pattern module executes the selected firing pattern when the vibration characteristics associated with the combined firing pattern satisfy the predetermined criteria.

9. The system of claim 7 wherein the firing pattern module executes the selected firing pattern when the amplitude of vibration resulting from the selected firing pattern is less than a predetermined displacement.

10. The system of claim 7 wherein the firing pattern module executes the selected firing pattern when vibration resulting from the selected firing pattern decreases the amplitude of vibration resulting from the previous firing pattern.

11. A method comprising:

storing vibration characteristics including at least one of an amplitude, a frequency, and a phase of vibration at a driver interface component, wherein each of the vibration characteristics is associated with one of a first plurality of firing patterns of an engine when a cylinder of the engine is deactivated;

selecting a firing pattern from a second plurality of firing patterns; and executing the selected firing pattern when the vibration characteristics resulting from the selected firing pattern satisfy predetermined criteria.

12. The method of claim 11 further comprising randomly selecting the selected firing pattern from the plurality of firing patterns.

13. The method of claim 11 wherein the second plurality of firing patterns includes those of the first plurality of firing patterns that include a sufficient number of firing events to satisfy a driver torque request.

14. The method of claim 11 further comprising designating as a desired firing pattern those of the plurality of firing patterns that satisfy the predetermined criteria.

15. The method of claim 11 further comprising executing the selected firing pattern when the selected firing pattern is designated as a desired firing pattern.

16. The method of claim 11 wherein the second plurality of firing patterns includes only those of the first plurality of firing patterns that satisfy the predetermined criteria.

17. The method of claim 11 further comprising combining the selected firing pattern with at least a portion of a previous firing pattern and determining the vibration characteristics of the combined firing pattern.

18. The method of claim 17 further comprising executing the selected firing pattern when the vibration characteristics associated with the combined firing pattern satisfy the predetermined criteria.

19. The method of claim 17 further comprising executing the selected firing pattern when the amplitude of vibration resulting from the selected firing pattern is less than a predetermined displacement.

20. The method of claim 17 further comprising executing the selected firing pattern when vibration resulting from the selected firing pattern decreases the amplitude of vibration resulting from the previous firing pattern.

* * * * *